United States Patent [19]

St-Hilaire

[11] Patent Number: 4,587,599

[45] Date of Patent: May 6, 1986

[54] PORTHOLE ASSEMBLY FOR A SWIMMING-POOL WALL

[76] Inventor: Normand St-Hilaire, 34 rang Ste-Claire, Ste-Anne-des-Plaines, Canada, JON 1HO

[21] Appl. No.: 649,716

[22] Filed: Sep. 12, 1984

[51] Int. Cl.[4] ..... F21V 33/00

[52] U.S. Cl. ..... 362/101; 362/267; 362/318

[58] Field of Search ..... 362/267, 318, 101, 96

[56] References Cited

U.S. PATENT DOCUMENTS

| | | | |
|---|---|---|---|
| 1,792,398 | 2/1931 | Rothen | 362/267 |
| 3,192,379 | 6/1965 | DeGarmo | 362/267 |
| 3,339,066 | 8/1967 | Hart | 362/267 |
| 4,107,768 | 8/1978 | Lemkin | 362/363 |
| 4,219,871 | 8/1980 | Larrimore | 362/267 X |
| 4,368,508 | 1/1983 | Gantenbrink | 362/267 |
| 4,394,716 | 7/1983 | Campagna et al. | 362/267 X |
| 4,450,511 | 5/1984 | Micha | 362/267 |

*Primary Examiner*—Peter A. Nelson
*Attorney, Agent, or Firm*—Cushman, Darby & Cushman

[57] ABSTRACT

The disclosure herein describes a porthole assembly adapted to be mounted in registry with an opening in a swimming-pool wall; the assembly comprises a lamp unit holder ring mounted to the outer face of the wall and a transparent cover plate disposed on the inner face of the swimming pool wall. The elements which secure the holder ring and the cover plate to the wall have tool-engaging ends accessible from outside the pool; their opposite ends are received in a water-tight arrangement on the cover plate so as to avoid all contact with the water of the pool. The engagement of the lamp unit to the holder ring is such that the light emitted is directed towards the bottom of the pool. The porthole assembly may be mounted to the wall of an above-ground swimming-pool as well as to an in-ground swimming-pool.

10 Claims, 4 Drawing Figures

PORTHOLE ASSEMBLY FOR A SWIMMING-POOL WALL

FIELD OF THE INVENTION

The present invention pertains to a porthole assembly for mounting to the wall of above-ground or in-ground swimming-pools and, more particularly, to a porthole assembly adapted to provide the pool with submerged illumination.

BACKGROUND OF THE INVENTION

Porthole assemblies for submerged illumination of above-ground swimming-pools are known as including generally a lamp unit holder ring and a transparent plate in registry with an opening in the pool wall. Such system is shown and described in Canadian Pat. 1010000 issued to Robert Cantin on May 10, 1977 and assigned to the present applicant. The method of mounting this assembly to the pool wall consists in submerging the cover plate, the securing bolts and the fastening tool while maintaining the holding ring outside the pool in vertical registry with the plate. A further incovenience of present porthole assemblies is that the bolts have portions in contact with the water of the pool causing rust. Also, a gasket is required between the wall and the plate but is often inadequate as water infiltrates through the bolt passages of the assembly.

OBJECTS AND STATEMENT OF THE PRESENT INVENTION

It is an object of the present invention to provide a porthole assembly of the type described where the mounting of the holder ring and the cover plate to the swimming-pool wall is greatly facilitated by allowing access to the securing bolts from outside the pool thus reducing the submerged operations to a simple manual holding procedure of the cover plate while securing the first bolts.

It is also an object of the present invention to provide a porthole assembly wherein the securing bolts have no parts contacting the water of the swimming-pool.

The present invention therefore relates to a porthole assembly which is adapted to be mounted in registry with an opening in a swimming-pool wall having an inner and an outer face, the assembly comprising:

a lamp unit holding means mounted to the outer face peripherally of the opening;

transparent cover means mounted to the inner face over the opening;

means for securing the cover means and the holding means to the swimmning-pool wall, the securing means having a tool-engaging end which is accessible from outside of the swimming-pool;

means on the cover means for receiving the opposite end of the securing means in a water-tight arrangement so as to avoid contact of the securing means with the water of the swimming-pool; and a lamp unit removably mounted to the holding means.

In one form of the invention, the cover has a plurality of circumferentially-spaced holes which are in registry with corresponding holes in the holding means; a plurality of enclosed housings are defined adjacent each hole to receive in a water-tight arrangement the extremity of the securing means.

The holding means consists of a cylindrical body having a longitudinal flange and an inner flange integrally mounted at one end of the longitudinal flange. Means are provided on the longitudinal flange to hold the lamp unit in such a way as to direct light emitted down towards the bottom of the swimming-pool.

Other objects and further scope of applicability of the present invention will become apparent from the detailed description given hereinafter. It should be understood, however, that this detailed description, while indicating preferred embodiments of the invention, is given by way of illustration only since various changes and modifications within the spirit and scope of the invention will become apparent to those skilled in the art.

DESCRIPTION OF PREFERRED EMBODIMENTS

Figure 1:
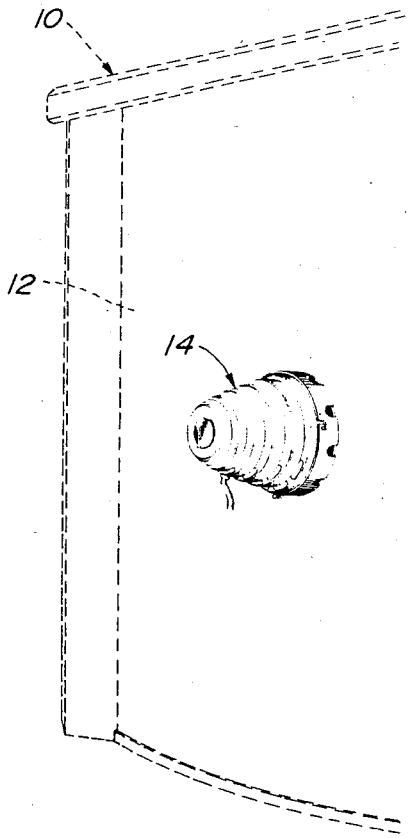
FIG. 1 is a perspective view of a porthole assembly made in accordance with the present invention being shown mounted to an above-ground swimming-pool wall.

Referring to FIG. 1, there is shown, in dotted lines, a swimming-pool 10 having a peripheral side wall 12 formed of sheet metal 12' and an internal lining 12'' of plastic such as vinyl. A porthole assembly, generally denoted 14, made in accordance with the present invention, is once shown mounted to the wall.

The porthole assembly comprises broadly a lamp unit 16, a holder ring 18 and a transparent cover plate 20.

Figure 3:
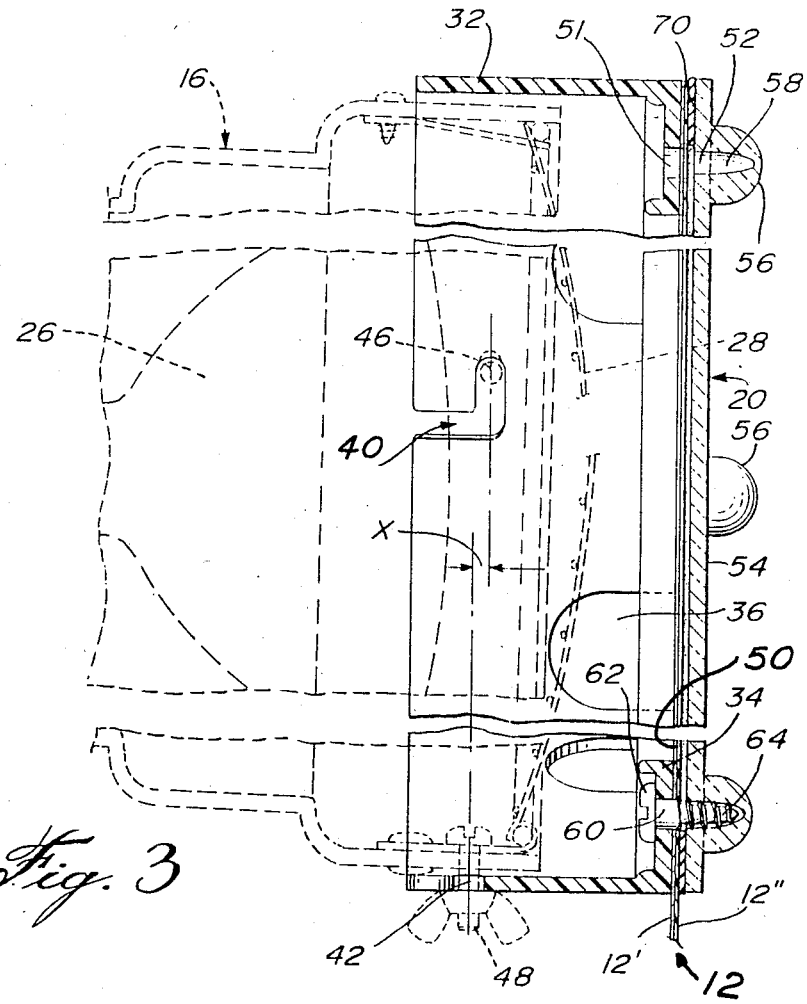
FIG. 3 is an elevational cross-sectional view of the porthole assembly showing the lamp unit in dotted lines.

The lamp unit 16 has a conical-shaped housing 22 with a series of ventilation holes 24 on the underside and includes therein a light bulb 26, shown in dotted lines in FIG. 3 with a safety grid 28 at the open end thereof. An electrical cored 30 connects the bulb socket (not shown) to a remote electrical source.

Figure 2:
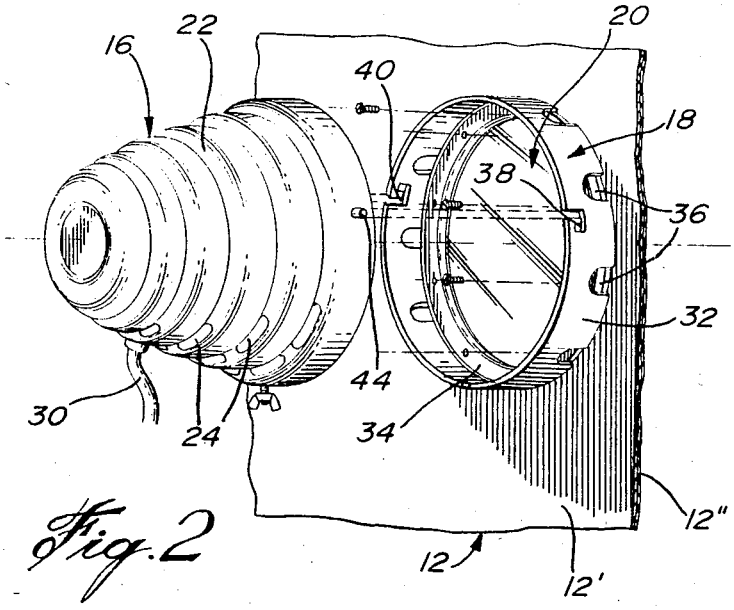
FIG. 2 is a perspective view showing the lamp unit in exploded view with the holder ring and the transparent cover mounted to the wall.

Referring to FIGS. 2 and 3, the holder ring 18 has a cylindrical shape with a longitudinal side flange 32 which is perpendicular to the pool wall 12 and an annular inner flange 34 integral with the side flange and parallel to the pool wall. The longitudinal flange is provided with a series of circumferentially-spaced ventilation openings 36 adjacent the inner flange 34 and with a series of L-shaped grooves (three being shown as 38, 40 and 42). These grooves are adapated to receive therein a corresponding number of studs 44, 46, 48 projecting from the outside wall of the lamp housing 22. As can be seen in FIG. 3, the stud 46 in groove 40 is offset vertically with respect to the stud 48 in groove 42 by a distance X, which results in disposing the lamp unit 16 at an angle relative to an axis normal to the pool wall 12. As the annular flange 34 abuts the inner face 50 of the wall 12, the offset of the studs results in having light illumination directed towards the bottom of the pool (see FIG. 4).

Covering the wall opening as well as a peripheral area thereabout is the transparent cover plate 20 which has a circular configuration and is made of a plastic material such as polycarbonate. This cover plate comprises a series of circumferentially-spaced holes 52 which are in registry with corresponding holes 51 of the annular flange 34. From the outer face 54 of the cover plate projects a series of enclosed housings 56 having a cavity 58 therein extending in the prolongation of the opening 52. In one preferred form of the invention, these housings are integrally formed with the cover plate.

In order to mount the cover plate and the holder ring to the wall of the pool, a self-tapping screw 60 extends through each hole of the cover plate and each corresponding hole of the inner flange 34. Screw 60 has a tool-receiving head 62 extending within the holder ring, i.e. outside the swimming-pool wall, while its threaded end 64 engages the cover plate and is received in the water-sealed cavity 58 of the housing 56. This particular arrangement prevents any water contact between the screws and the water of the swimming-pool. With this arrangement, it is no longer necessary to provide between the cover plate and the wall of the pool a large gasket which the bolts protrude. A water sealant 70 of plastic material is only required within the area defined by the peripheral edge of wall lining 72, the securing screws 60 and the peripheral edge of the inner face of the cover plate 20.

Figure 4:
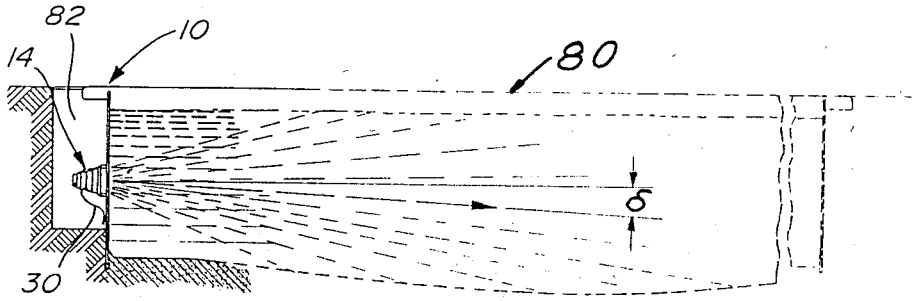
FIG. 4 is a schematic representation showing the submerged illumination created by the assembly of the present invention in a sunken swimming-pool.

Referring to FIG. 4, the illumination obtained from the porthole assembly described above for an in-ground swimming-pool 80 is principally directed towards the bottom of the pool. The longitudinal axis of the light bulb forms an angle $\epsilon$ with the horizontal plane of the pool. This deviation is created by the offset of the connection between the studs and the grooves. It may also be obtained by giving an inclination to the bulb socket within the housing.

The above-described porthole assembly, when mounted to an in-ground swimming-pool, is located in an access-well 82.

The installation of the porthole assembly of the present invention to an above-ground or sunken swimming-pool will now be described. First, a hole is cut through the sheet metal wall 12' but not through the lining 12''. The cover plate 20 with its sealant 70 on the inner face thereof is lowered and submerged in the pool in registry with the cut hole. The holder ring 18 is placed in registry with the cut hole and the screws 60 are inserted in the holes of the annular flange 34, forced through the sheet metal and lining and finally its ends received in the cavities 58. The head of the screws being accessible from outside the pool, no work is done underwater except for a short manual holding operation of the cover plate to initiate the engagement of the first-installed screws to the plate. Once the ring is installed, the lining is cut adjacent the annular flange 34 and removed so that one can now see in the pool through the transparent plate 20. The lamp unit 16 is then secured to the holder ring.

Although the invention has been described in relation to preferred forms, it will be evident to the person skilled in the art that it may be modified and refined in various ways. It is therefore wished to have it understood that the present invention should not be limited into interpretation except by the terms of the following claims.

The embodiments of the invention in which an exclusive property or privilege is claimed are defined as follows:

1. A porthole assembly for mounting in registry with an opening in a swimming-pool wall having an inner and outer face, said porthole preventing water in the swimming-pool from passing through said opening, and said porthole assembly comprising:

a lamp unit holding means mounted against said outer face peripherally of said opening;

a continuous transparent cover means mounted against said inner face and completely spanning said opening so that water from the swimming-pool cannot pass therethrough;

means for securing said cover means and said holding means to said wall, the securing means having a tool-engaging end accessible from outside said swimming-pool;

means on said cover means for receiving the opposite end of said securing means in a watertight arrangement so as to avoid contact between said securing means and water in said swimming-pool; and a lamp unit removably mounted to said holding means, said lamp unit being separate and distinct from said transparent cover means.

2. A porthole assembly as defined in claim 1, wherein said cover means is a transparent plate having a plurality of circumferentially-spaced holes each receiving one of said securing means therethrough; said means for receiving the opposite end of said securing means defining a plurality of enclosed housings mounted to the outer face of said plate for contact with water in the swimming-pool, said housings being in registry with said holes, and said housings providing continuity of said transparent cover means so that water from said swimming-pool may not pass therethrough.

3. A porthole assembly as defined in claim 2, wherein said housings are integrally formed of said cover.

4. A porthole assembly as defined in claim 2 or 3, wherein said plate and said housings are made of polycarbonate.

5. A porthole assembly as defined in claim 1, further comprising water sealing means provided in a circumferential and peripheral area defined by the periphery of said swimming-pool wall, said securing means and the periphery of said cover means.

6. A porthole assembly as defined in claim 2, wherein said holding means consists of a cylindrical body having a longitudinal flange perpendicular to said wall and an inner flange integrally formed at one end of said longitudinal flange and extending parallel to said swimming-pool wall; said inner flange having holes in registry with said holes of said plate to receive said securing means therethrough; means on said longitudinal flange for engagedly receiving cooperating means on said lamp unit for mounting said lamp unit to said holding means.

7. A porthole assembly as defined in claim 6, wherein said means on said longitudinal flange being so disposed therein as to mount said lamp unit at an angle relative to an axis normal to said swimming-pool wall whereby light emitted from said lamp unit is directed towards the bottom of said swimming-pool.

8. A porthole assembly as defined in claim 7, wherein said means on said longitudinal flange are L-shaped grooves and wherein said cooperating means on said lamp units are studs received in said L-shaped grooves.

9. A porthole assembly as defined in claim 6, further comprising ventilation openings on said lamp unit and on said longitudinal flange of said holding means.

10. A porthole assembly adapted to be mounted in registry with an opening in a swimming-pool wall having an inner and outer face comprising:

a lamp unit holding means mounted to said outer face peripherally of said opening;

transparent cover means mounted to said inner face over said opening;

means for securing said cover means and said holding means to said wall, said securing means having a tool-engaging end accessible from outside said swimming-pool;

means on said cover means for receiving the opposite end of said securing means in a watertight arrangement so as to avoid contact between said securing means and water in said swimming-pool;

a lamp unit removably mounted to said holding means;

said cover means comprising a transparent plate having a plurality of circumferentially-spaced holes each receiving one of said securing means therethrough; said means for receiving the opposite end of said securing means defining a plurality of enclosed housings mounted to the outer face of said plate and in registry with said holes;

said holding means comprising a cylindrical body having a longitudinal flange perpendicular to said wall and an inner flange integrally formed at one end of said longitudinal flange and extending parallel to said swimming-pool wall; said inner flange having holes in registry with said holes of said plate to receive said securing means therethrough; means on said longitudinal flange for engagedly receiving cooperating means on said lamp unit for mounting said lamp unit to said holding means; and ventilation openings on said lamp unit and on said longitudinal flange of said holding means.

* * * * *